United States Patent [19]

Goller et al.

[11] Patent Number: 4,503,689

[45] Date of Patent: Mar. 12, 1985

[54] FABRIC TAKE-DOWN MECHANISM FOR FLAT KNITTING MACHINES

[75] Inventors: Ernst Goller, Reutlingen; Günther Kazmaier, St. Johann; Hans-Dieter Trissler, Reutlingen; Henning Schmidt, Ohmenhausen, all of Fed. Rep. of Germany

[73] Assignee: H. Stoll GmbH & Co., Reutlingen, Fed. Rep. of Germany

[21] Appl. No.: 517,720

[22] Filed: Jul. 27, 1983

[30] Foreign Application Priority Data

Aug. 4, 1982 [DE] Fed. Rep. of Germany ..... 3229031

[51] Int. Cl.[3] ..... D04B 15/88

[52] U.S. Cl. ..... 66/149 R; 66/152

[58] Field of Search ..... 66/149 R, 152

[56] References Cited

U.S. PATENT DOCUMENTS 3,760,609 9/1973 Poocza et al. ..... 66/149 R

FOREIGN PATENT DOCUMENTS 2648612 5/1978 Fed. Rep. of Germany ..... 66/152

950827 8/1982 U.S.S.R. ..... 66/149 R

*Primary Examiner*—Ronald Feldbaum

*Attorney, Agent, or Firm*—Larson and Taylor

[57] ABSTRACT

The fabric take-down mechanism for flat knitting machines has an auxiliary take-down roller (22) following the main take-down roller (10) and extending over the whole length of the needle beds, this auxiliary roller having edges (24) and being grounded through metallic retaining loops (25). The auxiliary take-down roller (22) cooperates with a smooth but likewise electrical conducting counter plate (21).

9 Claims, 1 Drawing Figure

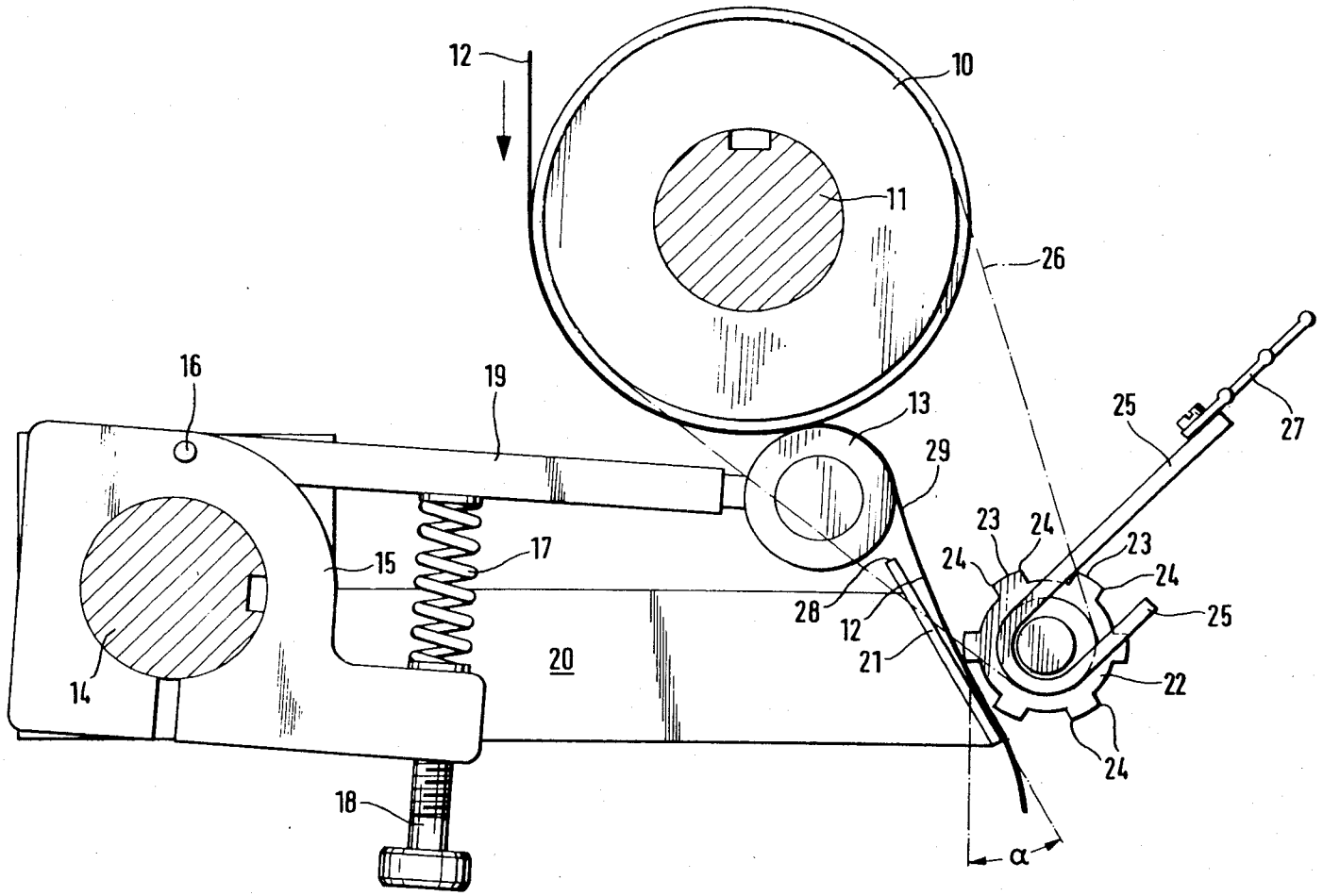
10
11
12
13
14
15
16
17
18
19
20
21
22
23
24
25
26
27
28
29
α

FABRIC TAKE-DOWN MECHANISM FOR FLAT KNITTING MACHINES

The invention relates to a fabric take-down mechanism for flat knitting machines, particularly those for the manufacture of shaped knitted products, having a take-down roller disposed beneath the needle beds and a spring-loaded press roller.

In the industrial manufacture of knitted fabrics it is impossible to avoid a greater or lesser static charging of the fabric dependent on the yarn material. The static charging of the fabric interfaces with the withdrawal of the knitted fabric because the latter has the tendency to adhere to the surface of the take-down roller or the press roller. In the case of shaped fabrics with floating threads, the danger is increased because the knitted fabric or the free threads and thread ends tend to wind around the take-down implements.

The attempt has therefore been made by using electrically conducting rubber layers on the take-down rollers to remove any static loading of the fabric. It has however been found because of the limited conductivity of such coverings that there is not a complete guarantee of the interference with the take-down of the fabric referred to above.

The object of the present invention is to so construct a fabric take-down mechanism as to achieve a complete elimination of any electrical charging of the fabric and to avoid the danger of any winding of the knitted fabric on the take-down rollers or any other take-down members.

The object sought is met in a fabric take-down mechanism of the kind set forth above in the present invention by the fact that it has an auxiliary take-down roller disposed after the press roller in the take-down direction and having an electrically conducted, earthed surface equipped with longitudinal edges, and by a smooth electrically conducting counter plate which is disposed at an angle to the vertical, the knitted fabric passing from the counter roller being conducted between the counter plate and the auxiliary take-down roller.

The edged surface of the grounded auxiliary take-down roller caters first of all for a safe uncharging of the knitted fabric and on the other hand secure engagement of loose marginal sections and free lying threads and thread end section of the fabric. This as a result avoids the danger that the knitted fabric or individual sections of the fabric can roll up on the take-down roller or the press roller, and devices for detecting the rolling up of the knitwear on the take-down rollers, which have hitherto been used are eliminated.

The auxiliary take-down roller may be run slightly faster than the main take-down roller so that the knitted fabric engaged thereby is tautened without the knitwear being thereby pulled along. The use of an auxiliary take-down roller does not require any large outlay. It may advantageously be driven through two belts from the main take-down roller and can be suspended both in these driving belts and in freely hung metal loops which provide the grounding. The smooth counter plate and its inclined disposition facilitates the passage of the knitted fabric. This counter plate together with the press roller can be swung aside and after the commencement of the formation of the knitwear can be swung back into contact with the fabric formed against the take-down roller again in its operative position.

An example of embodiment of a fabric take-down mechanism constructed in accordance with the invention will now be explained with reference to the accompanying drawing which shows a cross section through the parts of the mechanism of the flat knitting machine in accordance with the invention.

The drawing illustrates the main take-down roller 10 of a take-down mechanism disposed beneath the needle beds in known fashion, this being secured to a driven shaft 11 and through which the knitted fabric 12, shown in thicker line, is tangentially engaged and moved vertically downwards from the knitting zone (not shown) of the machine. This knitted fabric can be composed of a plurality of side-by-side individual lengths of fabric of fluctuating width. Cooperating with the main take-down roller 10 is a press roller 13 which is mounted for free rotation at the end of a lever 19. The lever 19 is mounted for limited pivotal movement about a pin 16 in a bracket 15 secured to the adjusting shaft 14, and it is subject to the action of a compression spring 17 in which the loading can be varied by means of a setscrew 18. Also secured to the setting shaft 14 is an arm 20 which carries at its free end a smooth counter plate 21 disposed at an angle $\alpha$ of about 30°–50° to the vertical. By turning the said shaft 14 through about 90° in the clockwise direction the bracket 15 with the pivotal lever 19 and the arm 20 can be swung downwards.

Opposite the counter plate 21 which extends over the full length of the main take-down roller 10 lies an auxiliary take-down roller 22 parallel to the main take-down roller 10 and the press roller 13 and laterally offset, the surface of which is provided by longitudinal ribs 23 with edges 24. This auxiliary roller 22 is suspended at the two end parts on the one hand in a metallic loop 25 and at the other in an endless driving belt 26, through which it is driven from the main take-down roller 10. The metallic loops 25 are connected through metallic chains 27 with the metal frame (not shown) of the flat knitting machine and are thereby grounded. The auxiliary take-down roller 22 is likewise made of metal so as to provide through the metal loop 25 a satisfactory electrical grounding of the auxiliary take-down roller.

The upper edge 28 of the inclined counter plate 21 is set back behind the knitted fabric lifting part of the press roller depicted with the reference numeral 29, so that it acts as a deflector plate for any knitted fabric adhering to the counter press roller 13. The belt drive 26 for the auxiliary take-down roller 22 may be so formed that the peripheral speed of the roller 22 is slightly more than that of the main take-down roller 10 and there is a slight tightening of the taken down fabric 12 between the lifting zone 29 of the press roller 13 and the edged surface of the auxiliary roller 22. Experience in meeting the object sought in the present invention is found in the edged construction of the surface of the auxiliary take-down roller 22 and can also be achieved by the formation of ribs 23, for example by providing a polygonal cross section for the roller 22 or by the formation of the auxiliary roller 22 as a toothed roller.

We claim:

1. A fabric take-down mechanism for flat knitting machines, particularly those designed for the production of shaped knitted products, comprising a take-down roller disposed beneath the needle beds and a spring loaded press roller, characterised by an auxiliary take-down roller (22) disposed after the press roller (13) in the take-down direction and having an electrically conducted, earthed surface equipped with longitudinal edges (24), and by a smooth electrically conducting counter plate (21) which is disposed at an angle ($\alpha$) to the vertical, the knitted fabric (12) passing from the counter roller (13) being conducted between the counter plate (21) and the auxiliary take-down roller (22).

2. A fabric take-down mechanism according to claim 1, characterised by the fact that the auxiliary take-down roller (22) turns slightly faster than the main take-down roller (10).

3. A fabric take-down mechanism according to claim 1 or claim 2, characterised by the fact that the auxiliary take-down roller (22) is driven through belts (26) from the main take-down roller (10) and is suspended both in these driving belts (26) and also in freely hanging metal loops (25) effecting the grounding.

4. A fabric take-down mechanism according to one of claims 1 to 3, characterised by the fact that the counter plate (21) is secured to arm (20) which is pivotally arranged together with the press roller (13).

5. A fabric take-down mechanism according to one of claims 1 to 4, characterised by the fact that the upper edge (28) of the counter plate (21) is arranged offset and behind the knitwear lifting area (29) of the press roller (13).

6. A fabric take-down mechanism according to one of claims 1 to 5, characterised by the fact that the edged surface of the auxiliary take-down roller (22) is produced by a polygonal cross section of the roller body.

7. A fabric take-down mechanism according to one of claims 1 to 5, characterised by the fact that the edged surface of the auxiliary take-down roller is produced by longitudinal loops (23) and/or longitudinal grooves.

8. A fabric take-down mechanism according to one of claims 1 to 7, characterised by the fact that the angle ($\alpha$) between the counter plate (21) and the vertical lies between 30° and 50°.

9. A fabric take-down mechanism according to one of claims 1 to 8, characterised by the fact that the metal loops (25) in which the auxiliary take-down roller (22) is hung is connected to the machine frame through chains (27), belts or the like.

* * * * *